US009212542B2

(12) United States Patent
Fripp et al.

(10) Patent No.: US 9,212,542 B2
(45) Date of Patent: Dec. 15, 2015

(54) EXPANDABLE TUBING RUN THROUGH PRODUCTION TUBING AND INTO OPEN HOLE

(71) Applicant: Halliburton Energy Services, Inc., Houston, TX (US)

(72) Inventors: Michael Fripp, Carrollton, TX (US); John Gano, Carrollton, TX (US); Peter Besselink, Enschede (NL); Wilfried Van Moorleghem, Herk (BE)

(73) Assignee: Halliburton Energy Services, Inc., Houston, TX (US)

( * ) Notice: Subject to any disclaimer, the term of this patent is extended or adjusted under 35 U.S.C. 154(b) by 299 days.

(21) Appl. No.: 13/672,906

(22) Filed: Nov. 9, 2012

(65) Prior Publication Data

US 2013/0220642 A1 Aug. 29, 2013

Related U.S. Application Data

(60) Provisional application No. 61/602,111, filed on Feb. 23, 2012.

(51) Int. Cl.
*E21B 43/12* (2006.01)
*E21B 33/13* (2006.01)
(Continued)

(52) U.S. Cl.
CPC ..... *E21B 43/12* (2013.01); *E21B 33/124* (2013.01); *E21B 33/1208* (2013.01);
(Continued)

(58) Field of Classification Search
CPC .. E21B 33/1208; E21B 43/103; E21B 43/108
USPC ..... 166/387, 277, 207, 212, 123, 278, 382
See application file for complete search history.

(56) References Cited

U.S. PATENT DOCUMENTS 1,301,285 A * 4/1919 Leonard ..... 166/179
1,476,830 A 12/1923 Newell
(Continued)

FOREIGN PATENT DOCUMENTS

EP 1223305 A2 7/2002
EP 1717411 A1 11/2006
(Continued)

OTHER PUBLICATIONS

International Search Report and Written Opinion for PCT/US2013/023733 dated Jun. 26, 2013.
(Continued)

*Primary Examiner* — Jennifer H Gay
(74) *Attorney, Agent, or Firm* — McDermott Will & Emery LLP; Scott Richardson

(57) ABSTRACT

A downhole completion assembly for sealing and supporting an open hole section of a wellbore includes a sealing structure movable between a contracted configuration and an expanded configuration, wherein, when in the contracted configuration, the sealing structure is able to axially traverse production tubing extended within a wellbore. A conveyance device is coupled to the sealing structure and configured to transport the sealing structure through the production tubing and to an open hole section of the wellbore. A deployment device is operably connected to the sealing structure and configured to radially expand the sealing structure from the contracted configuration to the expanded configuration when the sealing structure is arranged in the open hole section.

23 Claims, 4 Drawing Sheets

(51) Int. Cl.

| | |
|---|---|
| ***E21B 34/06*** | (2006.01) |
| ***E21B 43/10*** | (2006.01) |
| ***E21B 43/08*** | (2006.01) |
| ***E21B 33/12*** | (2006.01) |
| ***E21B 33/124*** | (2006.01) |

(52) U.S. Cl.

CPC ..... *E21B 33/13* (2013.01); *E21B 34/06* (2013.01); *E21B 43/08* (2013.01); *E21B 43/103* (2013.01); *E21B 43/106* (2013.01); *E21B 43/108* (2013.01)

(56) References Cited

U.S. PATENT DOCUMENTS

| | | | | |
|---|---|---|---|---|
| 3,203,451 | A * | 8/1965 | Vincent | 138/143 |
| 3,477,506 | A * | 11/1969 | Malone | 166/207 |
| 3,818,734 | A | 6/1974 | Bateman | |
| 4,484,625 | A | 11/1984 | Barbee, Jr. | |
| 5,343,949 | A | 9/1994 | Ross et al. | |
| 5,366,012 | A * | 11/1994 | Lohbeck | 166/277 |
| 5,597,042 | A | 1/1997 | Tubel et al. | |
| 5,609,178 | A | 3/1997 | Hennig et al. | |
| 5,635,675 | A | 6/1997 | Houga | |
| 6,142,230 | A | 11/2000 | Smalley et al. | |
| 6,253,850 | B1 * | 7/2001 | Nazzai et al. | 166/277 |
| 6,322,109 | B1 * | 11/2001 | Campbell et al. | 285/92 |
| 6,457,533 | B1 * | 10/2002 | Metcalfe | 166/381 |
| 6,478,092 | B2 | 11/2002 | Voll et al. | |
| 6,695,054 | B2 * | 2/2004 | Johnson et al. | 166/278 |
| 6,695,067 | B2 | 2/2004 | Johnson et al. | |
| 6,719,064 | B2 * | 4/2004 | Price-Smith et al. | 166/387 |
| 6,725,918 | B2 | 4/2004 | Gano | |
| 6,725,934 | B2 | 4/2004 | Coronado et al. | |
| 6,782,953 | B2 | 8/2004 | Maguire et al. | |
| 6,834,725 | B2 * | 12/2004 | Whanger et al. | 166/384 |
| 6,854,522 | B2 | 2/2005 | Brezinski et al. | |
| 6,863,130 | B2 | 3/2005 | Steele et al. | |
| 6,920,935 | B2 * | 7/2005 | Metcalfe | 166/382 |
| 7,048,048 | B2 | 5/2006 | Nguyen et al. | |
| 7,124,821 | B2 | 10/2006 | Metcalfe et al. | |
| 7,124,830 | B2 * | 10/2006 | Metcalfe | 166/382 |
| 7,152,687 | B2 | 12/2006 | Gano | |
| 7,172,027 | B2 * | 2/2007 | Simpson et al. | 166/382 |
| 7,216,706 | B2 | 5/2007 | Echols et al. | |
| 7,252,142 | B2 | 8/2007 | Brezinski et al. | |
| 7,341,110 | B2 | 3/2008 | Doane et al. | |
| 7,404,437 | B2 | 7/2008 | Brezinski et al. | |
| 7,758,628 | B2 | 7/2010 | Besselink | |
| 7,777,644 | B2 | 8/2010 | Madhavan et al. | |
| 7,895,726 | B2 * | 3/2011 | Maguire | 29/505 |
| 8,230,913 | B2 | 7/2012 | Hart et al. | |
| 8,360,142 | B2 * | 1/2013 | Durst et al. | 166/207 |
| 8,776,876 | B2 * | 7/2014 | Hart et al. | 166/207 |
| 8,776,899 | B2 | 7/2014 | Fripp et al. | |
| 2002/0046840 | A1 | 4/2002 | Schetky et al. | |
| 2002/0092648 | A1 | 7/2002 | Johnson et al. | |
| 2002/0092658 | A1 | 7/2002 | Johnson et al. | |
| 2002/0125008 | A1 * | 9/2002 | Wetzel et al. | 166/278 |
| 2002/0162664 | A1 * | 11/2002 | Bode et al. | 166/380 |
| 2003/0047322 | A1 | 3/2003 | Maguire et al. | |
| 2003/0056948 | A1 | 3/2003 | Cameron | |
| 2003/0089496 | A1 * | 5/2003 | Price-Smith et al. | 166/278 |
| 2003/0183395 | A1 * | 10/2003 | Jones | 166/380 |
| 2003/0234111 | A1 | 12/2003 | Echols et al. | |
| 2004/0060695 | A1 * | 4/2004 | Castano-Mears et al. | 166/228 |
| 2004/0074642 | A1 * | 4/2004 | Price-Smith et al. | 166/278 |
| 2004/0168799 | A1 * | 9/2004 | Simonds et al. | 166/278 |
| 2004/0251033 | A1 * | 12/2004 | Cameron et al. | 166/382 |
| 2005/0077052 | A1 * | 4/2005 | Ohmer | 166/384 |
| 2005/0279514 | A1 | 12/2005 | Metcalfe | |
| 2006/0037745 | A1 | 2/2006 | Hart et al. | |
| 2007/0029082 | A1 * | 2/2007 | Giroux et al. | 166/250.01 |
| 2007/0034386 | A1 * | 2/2007 | Henry | 166/387 |
| 2007/0084637 | A1 | 4/2007 | Orban et al. | |
| 2007/0095532 | A1 | 5/2007 | Head et al. | |
| 2007/0267201 | A1 * | 11/2007 | Brezinski et al. | 166/387 |
| 2008/0149349 | A1 | 6/2008 | Hiron et al. | |
| 2008/0230234 | A9 * | 9/2008 | Gano et al. | 166/384 |
| 2009/0151957 | A1 | 6/2009 | Sickle et al. | |
| 2009/0205843 | A1 * | 8/2009 | Gandikota et al. | 166/387 |
| 2009/0301733 | A1 * | 12/2009 | Shuster et al. | 166/378 |
| 2010/0071911 | A1 | 3/2010 | Carree | |
| 2010/0122820 | A1 * | 5/2010 | Holland | 166/387 |
| 2010/0243277 | A1 | 9/2010 | Ring | |
| 2010/0314130 | A1 | 12/2010 | Durst et al. | |
| 2011/0214855 | A1 | 9/2011 | Hart et al. | |
| 2011/0247813 | A1 | 10/2011 | Moen | |
| 2013/0056228 | A1 * | 3/2013 | Gruetzmann et al. | 166/387 |
| 2013/0220640 | A1 | 8/2013 | Fripp et al. | |
| 2013/0220641 | A1 | 8/2013 | Fripp et al. | |
| 2013/0220642 | A1 * | 8/2013 | Fripp et al. | 166/387 |
| 2013/0220643 | A1 | 8/2013 | Fripp et al. | |
| 2013/0220644 | A1 | 8/2013 | Fripp et al. | |
| 2014/0090857 | A1 | 4/2014 | Fripp et al. | |
| 2014/0196914 | A1 * | 7/2014 | Ring et al. | 166/387 |
| 2015/0075816 | A1 | 3/2015 | Jacob | |

FOREIGN PATENT DOCUMENTS

| | | | |
|---|---|---|---|
| GB | 2371064 | A | 7/2002 |
| GB | 2401131 | A | 11/2004 |
| WO | WO97/47850 | A1 | 12/1997 |
| WO | 2005003511 | A1 | 1/2005 |
| WO | 2013126190 | A1 | 8/2013 |
| WO | 2013126191 | A1 | 8/2013 |
| WO | 2013126192 | A1 | 8/2013 |
| WO | 2013126193 | A1 | 8/2013 |
| WO | 2013126194 | A1 | 8/2013 |

OTHER PUBLICATIONS

International Search Report and Written Opinion for PCT/UC2013/023720 dated May 15, 2013.

International Search Report and Written Opinion for PCT/US2013/023709 dated May 30, 2013.

International Search Report and Written Opinion for PCT/US2013/023736 dated May 14, 2013.

International Search Report and Written Opinion for PCT/US2013/023747 dated May 3, 2013.

Official Action for European Patent Application No. 13751125.9 dated Jul. 20, 2015.

* cited by examiner

EXPANDABLE TUBING RUN THROUGH PRODUCTION TUBING AND INTO OPEN HOLE

CROSS-REFERENCE TO RELATED APPLICATIONS

This present application claims priority to U.S. Provisional Patent App. No. 61/602,111 entitled "Extreme Expandable Packer and Downhole Construction," and filed on Feb. 23, 2012, the contents of which are hereby incorporated by reference in their entirety.

BACKGROUND

This present invention relates to wellbore completion operations and, more particularly, to a downhole completion assembly for sealing and supporting an open hole section of a wellbore.

Oil and gas wells are drilled into the Earth's crust and extend through various subterranean zones before reaching producing oil and/or gas zones of interest. Some of these subterranean zones may contain water and it is often advantageous to prevent the subsurface water from being produced to the surface with the oil/gas. In some cases, it may be desirable to block gas production in an oil zone, or block oil production in a gas zone. Where multiple oil/gas zones are penetrated by the same borehole, it is sometimes required to isolate the several zones, thereby allowing separate and intelligent production control from each zone for most efficient production. In traditionally completed wells, where a casing string is cemented into the wellbore, external packers are commonly used to provide annular seals or barriers between the casing string and the centrally-located production tubing in order to isolate the various zones.

It is increasingly common, however, to employ completion systems in open hole sections of oil and gas wells. In these wells, the casing string is cemented only in the upper portions of the wellbore while the remaining portions of the wellbore remain uncased and generally open (i.e., "open hole") to the surrounding subterranean formations and zones. Open hole completions are particularly useful in slanted wellbores that have borehole portions that are deviated and run horizontally for thousands of feet through producing and non-producing zones. Some of the zones traversed by the slanted wellbore may be water zones which must be generally isolated from any hydrocarbon-producing zones. Moreover, the various hydrocarbon-producing zones often exhibit different natural pressures and must be intelligently isolated from each other to prevent flow between adjacent zones and to allow efficient production from the low pressure zones.

In open hole completions, annular isolators are often employed along the length of the open wellbore to allow selective production from, or isolation of, the various portions of the producing zones. As a result, the formations penetrated by the wellbore can be intelligently produced, but the wellbore may still be susceptible to collapse or unwanted sand production. To prevent the collapse of the wellbore and sand production, various steps can be undertaken, such as installing gravel packs and/or sand screens. More modern techniques include the use of expandable tubing in conjunction with sand screens. These types of tubular elements may be run into uncased boreholes and expanded once they are in position using, for example, a hydraulic inflation tool, or by pulling or pushing an expansion cone through the tubular members.

In some applications, the expanded tubular elements provide mechanical support to the uncased wellbore, thereby helping to prevent collapse. In other applications, contact between the tubular element and the borehole wall may serve to restrict or prevent annular flow of fluids outside the production tubing. However, in many cases, due to irregularities in the borehole wall or simply unconsolidated formations, expanded tubing and screens will not prevent annular flow in the borehole. For this reason, annular isolators, such as casing packers, are typically needed to stop annular flow. Use of conventional external casing packers for such open hole completions, however, presents a number of problems. They are significantly less reliable than internal casing packers, they may require an additional trip to set a plug for cement diversion into the packer, and they are generally not compatible with expandable completion screens.

Efforts have been made to form annular isolators in open hole completions by placing a rubber sleeve on expandable tubing and screens and then expanding the tubing to press the rubber sleeve into contact with the borehole wall. These efforts have had limited success due primarily to the variable and unknown actual borehole shape and diameter. Moreover, the thickness of the rubber sleeve must be limited since it adds to the overall tubing diameter, which must be small enough to extend through small diameters as it is run into the borehole. The maximum size is also limited to allow the tubing to be expanded in a nominal or even undersized borehole. On the other hand, in washed out or oversized boreholes, normal tubing expansion is not likely to expand the rubber sleeve enough to contact the borehole wall and thereby form a seal. To form an annular seal or isolator in variable sized boreholes, adjustable or variable expansion tools have been used with some success. Nevertheless, it is difficult to achieve significant stress in the rubber with such variable tools and this type of expansion produces an inner surface of the tubing which follows the shape of the borehole and is not of substantially constant diameter.

SUMMARY OF THE INVENTION

This present invention relates to wellbore completion operations and, more particularly, to a downhole completion assembly for sealing and supporting an open hole section of a wellbore.

In one aspect of the disclosure, a downhole completion system may be disclosed. The system may include a sealing structure movable between a contracted configuration and an expanded configuration, wherein, when in the contracted configuration, the sealing structure is able to axially traverse production tubing extended within a wellbore, a conveyance device configured to couple to and transport the sealing structure through the production tubing, and a deployment device configured to radially expand the sealing structure from the contracted configuration to the expanded configuration.

In another aspect of the disclosure, a method of completing an open hole section of a wellbore may be disclosed. The method may include conveying a sealing structure in a contracted configuration to the open hole section of the wellbore with a conveyance device, the sealing structure being movable between the contracted configuration and an expanded configuration, and moving the sealing structure to the expanded configuration with a deployment device when the sealing structure is arranged in the open hole section.

In yet other aspects of the disclosure, another downhole completion system may be disclosed. The system may include a first sealing structure movable between a contracted configuration and an expanded configuration, a second sealing structure also movable between a contracted configuration and an expanded configuration, wherein, when in their respective contracted configurations, the first and second sealing structures are able to axially traverse production tubing extended within a wellbore, a conveyance device operably coupled to the first and second sealing structures and configured to transport the first and second sealing structures through the production tubing and to an open hole section of the wellbore, and a deployment device operably connected to the first and second sealing structures and configured to radially expand the first and second sealing structures from their respective contracted configurations to their respective expanded configurations when arranged in the open hole section, wherein the second sealing structure is arranged axially adjacent the first sealing structure within the open hole section.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

This present invention relates to wellbore completion operations and, more particularly, to a downhole completion assembly for sealing and supporting an open hole section of a wellbore.

The present invention provides a downhole completion system that features an expandable sealing structure and corresponding internal truss structure that are capable of being run through existing production tubing and subsequently expanded to clad and support the inner surface of an open hole section of a wellbore. Once the sealing structure is run to its proper downhole location, it may be expanded by any number of fixed expansion tools that are also small enough to axially traverse the production tubing. In operation, the expanded sealing structure may be useful in sealing the inner radial surface of the open borehole, thereby preventing the influx of unwanted fluids, such as water. The internal truss structure may be arranged within the sealing structure and useful in supporting the expanded sealing structure. The truss structure also serves to generally provide collapse resistance to the corresponding open hole section of the wellbore. In some embodiments, the sealing structure and corresponding internal truss structure are expanded at the same time with the same fixed expansion tool. In other embodiments, however, they may be expanded in two separate run-ins, thereby allowing the material for each structure to be thicker and more robust.

The disclosed downhole completion system may prove advantageous in that it is small enough to be able to be run-in through existing production tubing and into an open hole section of a wellbore. When expanded, the disclosed downhole completion system may provide sufficient expansion within the open hole section to adequately seal off sections or portions thereof and further provide wellbore collapse resistance. Once properly installed, the exemplary downhole completion system may stabilize, seal, and/or otherwise isolate the open hole section for long-term intelligent production operations. As a result, the life of a well may be extended, thereby increasing profits and reducing expenditures associated with the well. As will be apparent to those skilled in the art, the systems and methods disclosed herein may advantageously salvage or otherwise revive certain types of wells, such as watered-out wells, which were previously thought to be economically unviable.

Figure 1:
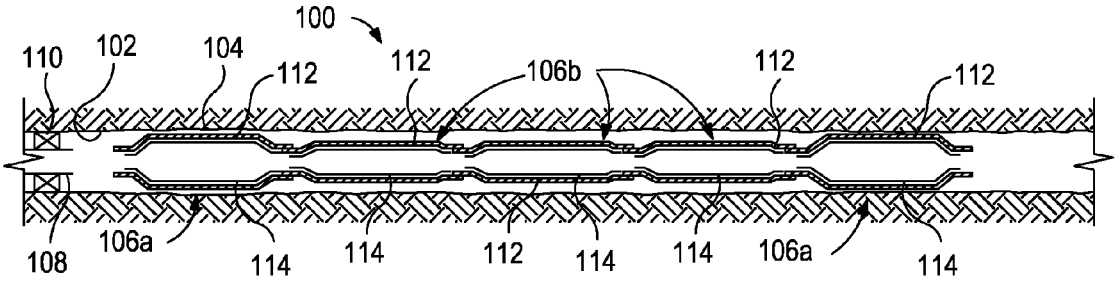
FIG. 1 illustrates an exemplary downhole completion system, according to one or more embodiments.

Referring to FIG. 1, illustrated is an exemplary downhole completion system 100, according to one or more embodiments disclosed. As illustrated, the system 100 may be configured to be arranged in an open hole section 102 of a wellbore 104. As used herein, the term or phrase "downhole completion system" should not be interpreted to refer solely to wellbore completion systems as classically defined or otherwise generally known in the art. Instead, the downhole completion system may also refer to or be characterized as a downhole fluid transport system. For instance, the downhole completion system 100, and the several variations described herein, may not necessarily be connected to any production tubing or the like. As a result, in some embodiments, fluids conveyed through the downhole completion system 100 may exit the system 100 into the open hole section 102 of the wellbore, without departing from the scope of the disclosure.

While FIG. 1 depicts the system 100 as being arranged in a portion of the wellbore 104 that is horizontally-oriented, it will be appreciated that the system 100 may equally be arranged in a vertical or slanted portion of the wellbore 104, or any other angular configuration therebetween, without departing from the scope of the disclosure. As illustrated, the downhole completion system 100 may include various interconnected sections or lengths extending axially within the wellbore 104. Specifically, the system 100 may include one or more end sections 106*a* (two shown) and one or more middle sections 106*b* coupled to or otherwise generally interposing the end sections 106*a*. As will be described in more detail below, the end and middle sections 106*a,b* may be coupled or otherwise attached together at their respective ends in order to provide an elongate conduit or structure within the open hole section 102 of the wellbore 104.

While only two end sections 106*a* and three middle sections 106*b* are depicted in FIG. 1, it will be appreciated that the system 100 can include more or less end and middle sections 106*a,b* without departing from the scope of the disclosure and depending on the particular application and downhole needs. Indeed, the system 100 can be progressively extended by adding various sections thereto, such as additional end sections 106*a* and/or additional middle sections 106*b*. Additional end and/or middle sections 106*a,b* may be added until a desired or predetermined length of the system 100 is achieved within the open hole section 102. Those skilled in the art will recognize that there is essentially no limit as to how long the system 100 may be extended to, only being limited by the overall length of the wellbore 104, the size and amount of overlapping sections, finances, and time.

In some embodiments, the end sections 106*a* may be sized such that they expand to seal against or otherwise clad the inner radial surface of the open hole section 102 when installed, thereby providing a corresponding isolation point along the axial length of the wellbore 104. As discussed in greater detail below, one or more of the end sections 106*a* may include an elastomer or other sealing element disposed about its outer radial surface in order to sealingly engage the inner radial surface of the open hole section 102. The middle sections 106*b* may or may not be configured to seal against the inner radial surface of the open hole section 102. For example, in some embodiments, such as is illustrated in FIG. 1, one or more of the middle sections 106*b* may be characterized as "straddle" elements configured with a fixed outer diameter when fully expanded and not necessarily configured to seal against or otherwise engage the inner radial surface of the open hole section 102. Instead, such straddle elements may be useful in providing lengths of connective tubing or conduit for sealingly connecting the end sections 106*a* and providing fluid communication therethrough.

In other embodiments, one or more of the middle sections 106*b* may be characterized as "spanner" elements configured with a fixed outer diameter and intended to span a washout portion of the open hole section 102. In some embodiments, such spanner elements may exhibit variable sealing capabilities by having a sealing element (not shown) disposed about their respective outer radial surfaces. The sealing element may be configured to sealingly engage the inner radial surface of the open hole section 102 where washouts may be present. In yet other embodiments, one or more of the middle sections 106*b* may be characterized as "sealing" elements configured to, much like the end sections 106*a*, seal a portion of the wellbore 104 along the length of the open hole section 102. Such sealing elements may have an outer diameter that is matched (or closely matched) to a caliper log of the open hole section 102.

In contrast to prior art systems, which are typically run into the open hole section 102 via a cased wellbore 104, the disclosed downhole completion system 100 may be configured to pass through existing production tubing 108 extending within the wellbore 104. In some embodiments, the production tubing 108 may be stabilized within the wellbore 104 with one or more annular packers 110 or the like. As can be appreciated by those skilled in the art, the production tubing 108 exhibits a reduced diameter, which requires the system 100 to exhibit an even more reduced diameter during run-in in order to effectively traverse the length of the production tubing 108 axially. For example, a 4.5 inch outer diameter production tubing 108 in a nominal 6.125 inch inner diameter open hole section 102 would require that the downhole completion system 100 would need to have a maximum diameter of 3.6 inches to pass through the nipples on the production tubing 102 and must be able to expand between 6-7.5 inches in the open hole section 102. Those skilled in the art will readily recognize that the range of diameters in the open hole section 102 is needed to account for potential irregularities in the open hole section 102. Moreover, in order to properly seal against the open hole section 102 upon proper deployment from the production tubing 108, the system 100 may be designed to exhibit a large amount of potential radial expansion.

Each section 106*a,b* of the downhole completion system 100 may include at least one sealing structure 112 and at least one truss structure 114. In other embodiments, however, the truss structure 114 may be omitted from one or more of the sections 106*a,b*, without departing from the scope of the disclosure. In some embodiments, the sealing structure 112 may be configured to be expanded and clad the inner radial surface of the open hole section 102, thereby providing a sealing function within the wellbore 104. In other embodiments, the sealing structure 112 may simply provide a generally sealed conduit or tubular for the system 100 to be connected to adjacent sections 106*a,b*.

As illustrated, and as will be discussed in greater detail below, at least one truss structure 114 may be generally arranged within a corresponding sealing structure 112 and may be configured to radially support the sealing structure 112 in its expanded configuration. The truss structure 114 may also be configured to or otherwise be useful in supporting the wellbore 104 itself, thereby preventing collapse of the wellbore 104. While only one truss structure 114 is depicted within a corresponding sealing structure 112, it will be appreciated that more than one truss structure 114 may be used within a single sealing structure 112, without departing from the scope of the disclosure. Moreover, multiple truss structures 114 may be nested inside each other as there is adequate radial space in the expanded condition for multiple support structures 114 and be radially small enough to traverse the interior of the production tubing 108.

Figure 2A:
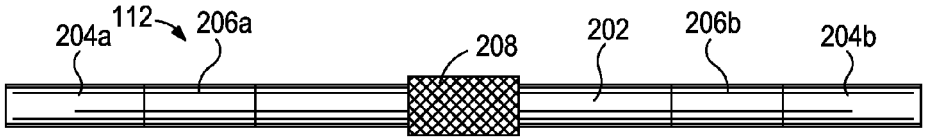
FIGS. 2A and 2B illustrate contracted and expanded sections of an exemplary sealing structure, according to one or more embodiments.
Figure 2B:
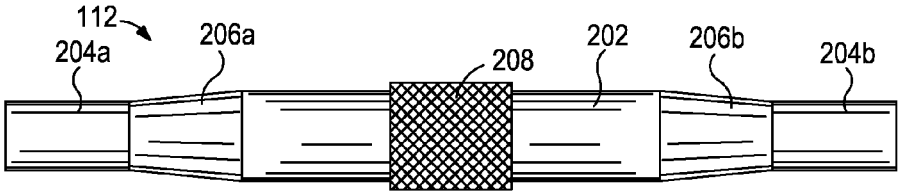

Referring now to FIGS. 2A and 2B, with continued reference to FIG. 1, illustrated is an exemplary sealing structure 112, according to one or more embodiments. Specifically, FIGS. 2A and 2B depict the sealing structure 112 in its contracted and expanded configurations, respectively. In its contracted configuration, as briefly noted above, the sealing structure 112 exhibits a diameter small enough to be run into the wellbore 104 through the reduced diameter of the production tubing 108. Once deployed from the production tubing 108, the sealing structure 112 is then able to be radially expanded into the expanded configuration.

In one or more embodiments, the sealing structure 112 may be an elongate tubular made of one or more metals or metal alloys. In other embodiments, the sealing structure 112 may be an elongate tubular made of thermoset plastics, thermoplastics, fiber reinforced composites, cementitious composites, combinations thereof, or the like. In embodiments where the sealing structure 112 is made of metal, the sealing structure 112 may be corrugated, crenulated, circular, looped, or spiraled. As depicted in FIGS. 2A and 2B, the sealing structure 112 is an elongate, corrugated tubular, having a plurality of longitudinally-extending corrugations or folds defined therein. Those skilled in the art, however, will readily appreciate the various alternative designs that the sealing structure 112 could exhibit, without departing from the scope of the disclosure. For example, in at least one embodiment, the sealing structure 112 may be characterized as a frustum or the like. In embodiments where the sealing structure 112 is made from corrugated metal, the corrugated metal may be expanded to unfold the corrugations or folds defined therein. In embodiments where the sealing structure 112 is made of circular metal, stretching the circular tube will result in more strain in the metal but will advantageously result in increased strength.

As illustrated, the sealing structure 112 may include or otherwise define a sealing section 202, opposing connection sections 204*a* and 204*b*, and opposing transition sections 206*a* and 206*b*. The connection sections 204*a,b* may be defined at either end of the sealing structure 112 and the transition sections 206*a,b* may be configured to provide or otherwise define the axial transition from the corresponding connector sections 204*a,b* to the sealing section 202, and vice versa. In at least one embodiment, each of the sealing section 202, connection sections 204*a,b*, and transition sections 206*a,b* may be formed or otherwise manufactured differently, or of different pieces or materials configured to exhibit a different expansion potential (e.g., diameter) when the sealing structure 112 transitions into the expanded configuration. For instance, the corrugations (i.e., the peaks and valleys) of the sealing section 202 may exhibit a larger amplitude or frequency (e.g., shorter wavelength) than the corrugations of the connection sections 204*a,b*, thereby resulting in the sealing section 202 being able to expand to a greater diameter than the connection sections 204*a,b*. As can be appreciated, this may allow the various portions of the sealing structure 112 to expand at different magnitudes, thereby providing varying transitional shapes over the length of the sealing structure 112. In some embodiments, the various sections 202, 204*a,b*, 206*a,b* may be interconnected or otherwise coupled by welding, brazing, mechanical attachments, combinations thereof, or the like. In other embodiments, however, the various sections 202, 204*a,b*, 206*a,b* are integrally-formed in a single-piece manufacture.

In some embodiments, the sealing structure 112 may further include a sealing element 208 disposed about at least a portion of the outer radial surface of the sealing section 202. In some embodiments, an additional layer of protective material may surround the outer radial circumference of the sealing element 208 to protect the sealing element 208 as it is advanced through the production tubing 108. The protective material may further provide additional support to the sealing structure 112 configured to hold the sealing structure 112 under a maximum running diameter prior to placement and expansion in the wellbore 104. In operation, the sealing element 208 may be configured to expand as the sealing structure 112 expands and ultimately engage and seal against the inner wall of the open hole section 102. In other embodiments, the sealing element 208 may provide lateral support for the downhole completion system 100 (FIG. 1). In some embodiments, the sealing element 208 may be arranged at two or more discrete locations along the length of the sealing section 202. The sealing element 208 may be made of an elastomer or a rubber, and may be swellable or non-swellable, depending on the application. In at least one embodiment, the sealing element 208 may be a swellable elastomer made from a mixture of a water swell and an oil swell elastomer.

In other embodiments, the material for the sealing elements 208 may vary along the sealing section 202 in order to create the best sealing available for the fluid type that the particular seal element may be exposed to. For instance, one or more bands of sealing materials can be located as desired along the length of the sealing section 202. The material used for the sealing element 208 may include swellable elastomeric, as described above, and/or bands of very viscous fluid. The very viscous liquid, for instance, can be an uncured elastomeric that will cure in the presence of well fluids. One example of such a very viscous liquid may include a silicone that cures with a small amount of water or other materials that are a combination of properties, such as a very viscous slurry of the silicone and small beads of ceramic or cured elastomeric material. The viscous material may be configured to better conform to the annular space between the expanded sealing structure 112 and the varying shape of the well bore 104 (FIG. 1). It should be noted that to establish a seal the material of the seal element 208 does not need to change properties, but only have sufficient viscosity and length in the small radial space to remain in place for the life of the well. The presence of other fillers, such as fibers, can enhance the viscous seal.

In other embodiments (not illustrated), the sealing element 208 is applied to the inner diameter of the open hole section 102 and may include such materials as, but not limited to, a shape memory material, swellable clay, hydrating gel, an epoxy, combinations thereof, or the like. In yet other embodiments, a fibrous material could be used to create a labyrinth-type seal between the outer radial surface of the sealing structure 112 and the inner diameter of the open hole section 102. The fibrous material, for example, may be any type of material capable of providing or otherwise forming a sealing matrix that creates a substantially tortuous path for any potentially escaping fluids. In yet further embodiments, the sealing element 208 is omitted altogether from the sealing structure 112 and instead the sealing section 202 itself is used to engage and seal against the inner diameter of the open hole section 102.

Figure 3A:
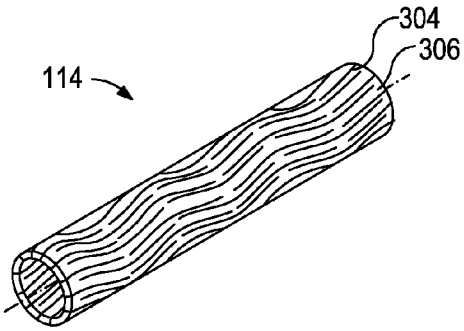
FIGS. 3A and 3B illustrate contracted and expanded sections of an exemplary truss structure, according to one or more embodiments.
Figure 3B:
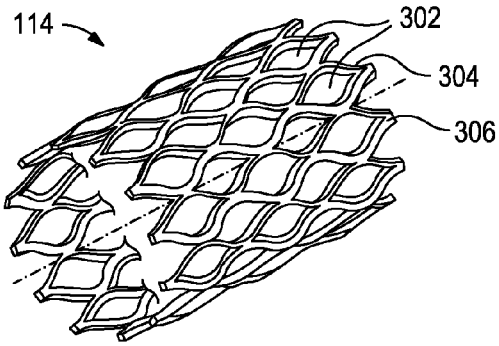

Referring now to FIGS. 3A and 3B, with continued reference to FIG. 1, illustrated is an exemplary truss structure 114, according to one or more embodiments. Specifically, FIGS. 3A and 3B depict the truss structure 114 in its contracted and expanded configurations, respectively. In its contracted configuration, the truss structure 114 exhibits a diameter small enough to be able to be run into the wellbore 104 through the reduced diameter production tubing 108. In some embodiments, the truss structure 114 in its contracted configuration exhibits a diameter small enough to be nested inside the sealing structure 112 when the sealing structure 112 is in its contracted configuration and able to be run into the wellbore 104 simultaneously through the production tubing 108. Once deployed from the production tubing 108, the truss structure 114 is then able to be radially expanded into its expanded configuration.

In some embodiments, the truss structure 114 may be an expandable device that defines or otherwise utilizes a plurality of expandable cells 302 that facilitate the expansion of the truss structure 114 from the contracted state (FIG. 3A) to the expanded state (FIG. 3B). In at least one embodiment, for example, the expandable cells 302 of the truss structure 114 may be characterized as bistable or multistable cells, where each bistable or multistable cell has a curved thin strut 304 connected to a curved thick strut 306. The geometry of the bistable/multistable cells is such that the tubular cross-section of the truss structure 114 can be expanded in the radial direction to increase the overall diameter of the truss structure 114. As the truss structure 114 expands radially, the bistable/multistable cells deform elastically until a specific geometry is reached. At this point the bistable/multistable cells move (e.g., snap) to an expanded geometry. In some embodiments, additional force may be applied to stretch the bistable/multistable cells to an even wider expanded geometry. With some materials and/or bistable/multistable cell designs, enough energy can be released in the elastic deformation of the expandable cell 302 (as each bistable/multistable cell snaps past the specific geometry) that the expandable cells 302 are able to initiate the expansion of adjoining bistable/multistable cells past the critical bistable/multistable cell geometry. With other materials and/or bistable/multistable cell designs, the bistable/multistable cells move to an expanded geometry with a nonlinear stair-stepped force-displacement profile.

At least one advantage to using a truss structure 114 that includes bistable/multistable expandable cells 302 is that the axial length of the truss structure 114 in the contracted and expanded configurations will be essentially the same. An expandable bistable/multistable truss structure 114 is thus designed so that as the radial dimension expands, the axial length of the truss structure 114 remains substantially constant. Another advantage to using a truss structure 114 that includes bistable/multistable expandable cells 302 is that the expanded cells 302 are stiffer and will create a high collapse strength with less radial movement.

Whether bistable/multistable or not, the expandable cells 302 facilitate expansion of the truss structure 114 between its contracted and expanded configurations. The selection of a particular type of expandable cell 302 depends on a variety of factors including environment, degree of expansion, materials available, etc. Additional discussion regarding bistable/multistable devices and other expandable cells can be found in co-owned U.S. Pat. No. 8,230,913 entitled "Expandable Device for use in a Well Bore," the contents of which are hereby incorporated by reference in their entirety.

Figure 4A:
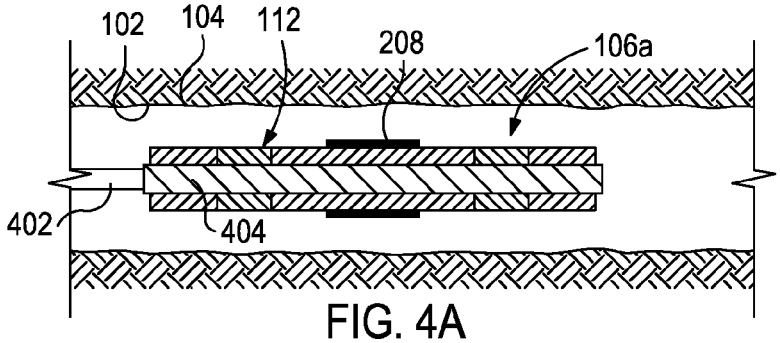
FIGS. 4A-4D illustrate progressive views of an end section of an exemplary downhole completion system being installed in an open hole section of a wellbore, according to one or more embodiments.

Referring now to FIGS. 4A-4D, with continued reference to FIGS. 1, 2A-2B, and 3A-3B, illustrated are progressive views of an end section 106*a* being installed or otherwise deployed within an open hole section 102 of the wellbore 104. While FIGS. 4A-4D depict the deployment or installation of an end section 106*a*, it will be appreciated that the following description could equally apply to the deployment or installation of a middle section 106*b*, without departing from the scope of the disclosure. As illustrated in FIG. 4A, a conveyance device 402 may be operably coupled to the sealing structure 112 and otherwise used to transport the sealing structure 112 in its contracted configuration into the open hole section 102 of the wellbore 104. As briefly noted above, the outer diameter of the sealing structure 112 in its contracted configuration may be small enough to axially traverse the axial length of the production tubing 108 (FIG. 1) without causing obstruction thereto. The conveyance device 402 may extend from the surface of the well and, in some embodiments, may be or otherwise utilize one or more mechanisms such as, but not limited to, wireline cable, coiled tubing, coiled tubing with wireline conductor, drill pipe, tubing, casing, combinations thereof, or the like.

Prior to running the sealing structure 112 into the wellbore 104, the diameter of the open hole section 102 may be measured, or otherwise calipered, in order to determine an approximate target diameter for sealing the particular portion of the open hole section 102. Accordingly, an appropriately-sized sealing structure 112 may be chosen and run into the wellbore 104 in order to adequately seal the inner radial surface of the wellbore 104.

A deployment device 404 may also be incorporated into the sealing structure 112 and transported into the open hole section 102 concurrently with the sealing structure 112 using the conveyance device 402. Specifically, the deployment device 404 may be operably connected or operably connectable to the sealing structure 112 and, in at least one embodiment, may be arranged or otherwise accommodated within the sealing structure 112 when the sealing structure 112 is in its contracted configuration. In other embodiments, the sealing structure 112 and the deployment device 404 may be run into the wellbore 104 separately, without departing from the scope of the disclosure. For example, in at least one embodiment, the sealing structure 112 and deployment device 404 may be axially offset from each other along the length of the conveyance device 402 as they are run into the wellbore 104. In other embodiments, the sealing structure 112 and deployment device 404 may be run-in on separate trips into the wellbore 104.

The deployment device 404 may be any type of fixed expansion tool such as, but not limited to, an inflatable balloon, a hydraulic setting tool (e.g., an inflatable packer element or the like), a mechanical packer element, an expandable swage, a scissoring mechanism, a wedge, a piston apparatus, a mechanical actuator, an electrical solenoid, a plug type apparatus (e.g., a conically shaped device configured to be pulled or pushed through the sealing structure 112), a ball type apparatus, a rotary type expander, a flexible or variable diameter expansion tool, a small diameter change cone packer, combinations thereof, or the like. Further description and discussion regarding suitable deployment devices 404 may be found in U.S. Pat. No. 8,230,913, previously incorporated by reference.

Figure 4B:
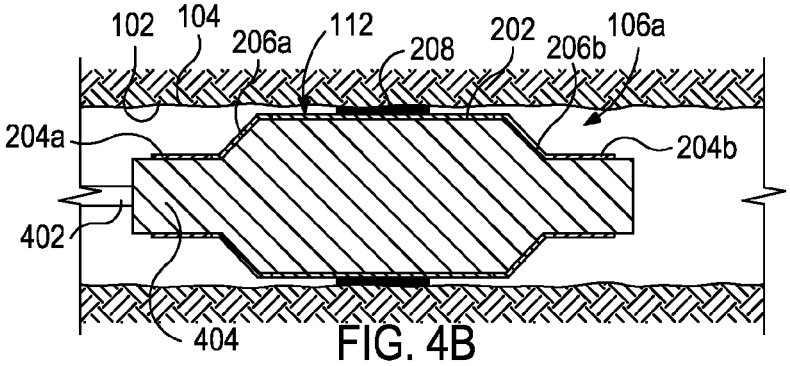

Referring to FIG. 4B, illustrated is the sealing structure 112 as it is expanded using the exemplary deployment device 404, according to one or more embodiments. In some embodiments, as illustrated, the sealing structure 112 is expanded until engaging the inner radial surface of the open hole section 102. The sealing element 208 may or may not be included with the sealing structure 112 in order to create an annular seal between the sealing structure 112 and the inner radial surface of the wellbore 104. As illustrated, the deployment device 404 may serve to deform the sealing structure 112 such that the sealing section 202, the connection sections 204*a,b*, and the transition sections 206*a,b* radially expand and thereby become readily apparent.

In embodiments where the deployment device 404 is a hydraulic setting tool, for example, the deployment device 404 may be inflated or otherwise actuated such that it radially expands the sealing structure 112. In such embodiments, the deployment device 404 may be actuated or otherwise inflated using an RDT™ (reservoir description tool) commercially-available from Halliburton Energy Services of Houston, Tex., USA. In other embodiments, the deployment device 404 may be inflated using fluid pressure applied from the surface or from an adjacent device arranged in the open hole section 102.

In one or more embodiments, the sealing structure 112 may be progressively expanded in discrete sections of controlled length. To accomplish this, the deployment device 404 may include short length expandable or inflatable packers designed to expand finite and predetermined lengths of the sealing structure 112. In other embodiments, the deployment device 404 may be configured to expand radially at a first location along the length of the sealing structure 112, and thereby radially deform or expand the sealing structure 112 at that first location, then deflate and move axially to a second location where the process is repeated. At each progressive location within the sealing structure 112, the deployment device 404 may be configured to expand at multiple radial points about the inner radial surface of the sealing structure 112, thereby reducing the number of movements needed to expand the entire sealing structure 112.

Those skilled in the art will recognize that using short expansion lengths may help to minimize the chance of rupturing the sealing structure 112 during the expansion process. Moreover, expanding the sealing structure 112 in multiple expansion movements may help the sealing structure 112 achieve better radial conformance to the varying diameter of the open hole section 102.

In operation, the sealing structure 112 may serve to seal a portion of the open hole section 102 of the wellbore 104 from the influx of unwanted fluids from the surrounding subterranean formations. As a result, intelligent production operations may be undertaken at predetermined locations along the length of the wellbore 104. The sealing structure 112 may also exhibit structural resistive strength in its expanded form and therefore be used as a structural element within the wellbore 104 configured to help prevent wellbore 104 collapse. In yet other embodiments, the sealing structure 112 may be used as a conduit for the conveyance of fluids therethrough.

Figure 4C:
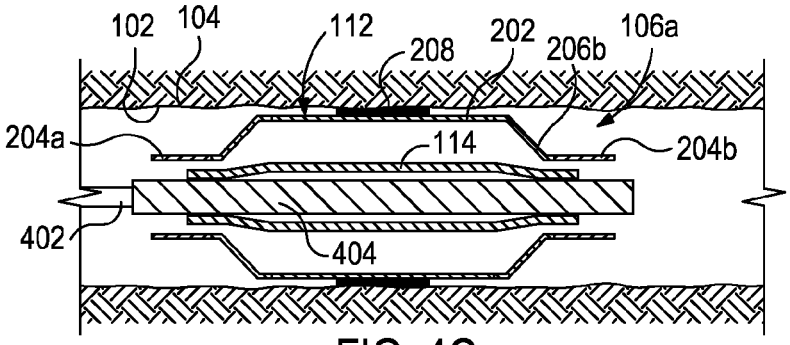

Referring to FIG. 4C, illustrated is the truss structure 114 in its contracted configuration as arranged within or otherwise being extended through the sealing structure 112. As with the sealing structure 112, the truss structure 114 may be conveyed or otherwise transported to the open hole section 102 of the wellbore 104 using the conveyance device 402, and may exhibit a diameter in its contracted configuration that is small enough to axially traverse the production tubing 108 (FIG. 1). In some embodiments, the truss structure 114 may be run in contiguously or otherwise nested within the sealing structure 112 in a single run-in into the wellbore 104. However, such an embodiment may not be able to provide as much collapse resistance or expansion ratio upon deployment since the available volume within the production tubing 108 may limit how robust the materials are that are used to manufacture the sealing and truss structures 112, 114.

Accordingly, in other embodiments, as illustrated herein, the truss structure 114 may be run into the open hole section 102 independently of the sealing structure 112, such as after the deployment of the sealing structure 112, and otherwise during the course of a second run-in into the wellbore 104. This may prove advantageous in embodiments where larger expansion ratios or higher collapse ratings are desired or otherwise required within the wellbore 104. In such embodiments, the downhole completion system 100 may be assembled in multiple run-ins into the wellbore 104, where the sealing structure 112 is installed separately from the truss structure 114.

In order to properly position the truss structure 114 within the sealing structure 112, in at least one embodiment, the truss structure 114 may be configured to land on, for example, one or more profiles (not shown) located or otherwise defined on the sealing structure 112. An exemplary profile may be a mechanical profile on the sealing structure 112 which can mate with the truss structure 114 to create a resistance to movement by the conveyance 402. This resistance to movement can be measured as a force, as a decrease in motion, as an increase in current to the conveyance motor, as a decrease in voltage to the conveyance motor, etc. The profile may also be an electromagnetic profile that is detected by the deployment device 404. The electromagnetic profile may be a magnet or a pattern of magnets, an RFID tag, or an equivalent profile that determines a unique location.

In some embodiments, the profile(s) may be defined at one or more of the connection sections 204*a,b* which may exhibit a known diameter in the expanded configuration. The known expanded diameter of the connection sections 204*a,b*, may prove advantageous in accurately locating an expanded sealing structure 112 or otherwise connecting a sealing structure 112 to a subsequent or preceding sealing structure 112 in the downhole completion system 100. Moreover, having a known diameter at the connection sections 204*a,b* may provide a means whereby an accurate or precise location within the system 100 may be determined.

Figure 4D:
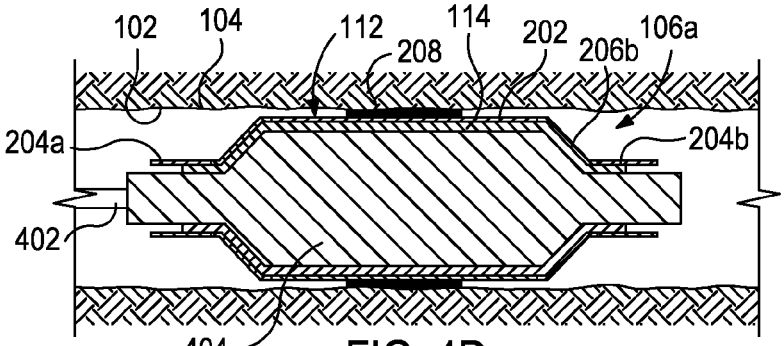

Referring to FIG. 4D, illustrated is the truss structure 114 as being expanded within the sealing structure 112. Similar to the sealing structure 112, the truss structure 114 may be forced into its expanded configuration using the deployment device 404. In at least one embodiment, the deployment device 404 is an inflatable packer element, and the inflation fluid used to actuate the packer element can be pumped from the surface through tubing or drill pipe, a mechanical pump, or via a downhole electrical pump which is powered via wireline cable.

As the deployment device 404 expands, it forces the truss structure 114 to also expand radially. In embodiments where the truss structure 114 includes bistable/multistable expandable cells 302 (FIG. 3B), at a certain expansion diameter the bistable/multistable expandable cells 302 reach a critical geometry where the bistable/multistable "snap" effect is initiated, and the truss structure 114 expands autonomously. Similar to the expansion of the sealing structure 112, the deployment device 404 may be configured to expand the truss structure 114 at multiple discrete locations. For instance, the deployment device 404 may be configured to expand radially at a first location along the length of the truss structure 114, then deflate and move axially to a second, third, fourth, etc., location where the process is repeated.

After the truss structure 114 is fully expanded, the deployment device 404 is radially contracted once more and removed from the deployed truss structure 114. In some embodiments, the truss structure 114 contacts the entire inner radial surface of the expanded sealing structure 112. In other embodiments, however, the truss structure 114 may be configured to contact only a few discrete locations of the inner radial surface of the expanded sealing structure 112.

In operation, the truss structure 114 in its expanded configuration supports the sealing structure 112 against collapse. In cases where the sealing structure 112 engages the inner radial surface of the wellbore 104, the truss structure 114 may also provide collapse resistance against the wellbore 104 in the open hole section 102. In other embodiments, especially in embodiments where the truss structure 114 employs bistable/multistable expandable cells 302 (FIG. 3B), the truss structure 114 may further be configured to help the sealing structure 112 expand to its fully deployed or expanded configuration. For instance, the "snap" effect of the bistable/multistable expandable cells 302 may exhibit enough expansive force that the material of the sealing structure 112 is forced radially outward in response thereto.

Figure 5:
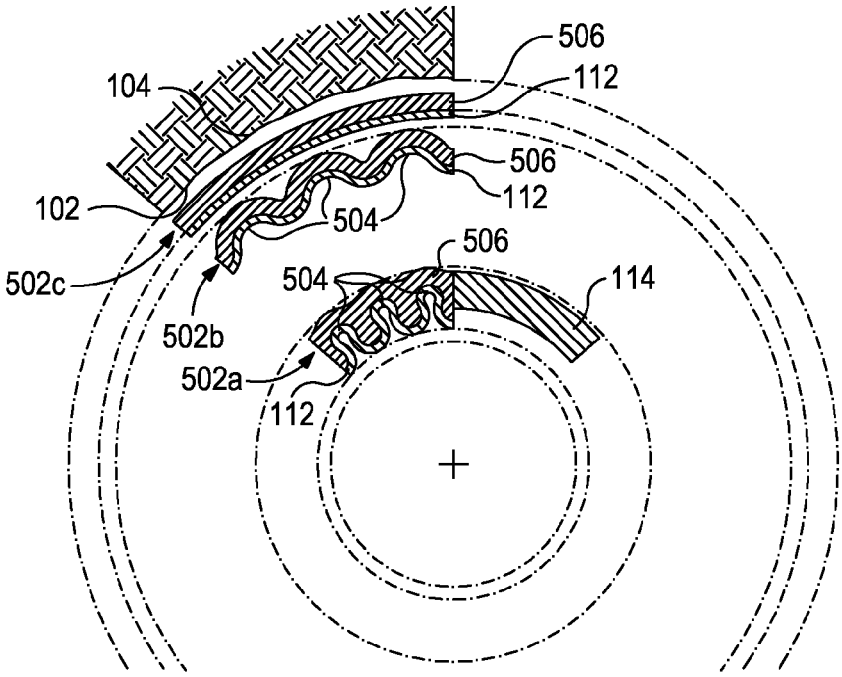
FIG. 5 illustrates a partial cross-sectional view of a sealing structure in its compressed, intermediate, and expanded configurations, according to one or more embodiments.

Referring now to FIG. 5, with continued reference to FIGS. 1, 2A-2B, and 4A-4B, illustrated is a cross-sectional view of an exemplary sealing structure 112 in progressive expanded forms, according to one or more embodiments. Specifically, the depicted sealing structure 112 is illustrated in a first unexpanded state 502*a*, a second expanded state 502*b*, and a third expanded state 502*c*, where the second expanded state 502*b* exhibits a larger diameter than the first unexpanded state 502*a*, and the third expanded state 502*c* exhibits a larger diameter than the second expanded state 502*b*. It will be appreciated that the illustrated sealing structure 112 may be representative of a sealing structure 112 that forms part of either an end section 106*a* or a middle section 106*b*, as described above with reference to FIG. 1, and without departing from the scope of the disclosure.

As illustrated, the sealing structure 112 may be made of a corrugated material, such as metal (or another material), thereby defining a plurality of contiguous, expandable folds 504 (i.e., corrugations). Those skilled in the art will readily appreciate that corrugated tubing may simplify the expansion process of the sealing structure 112, extend the ratio of potential expansion diameter change, reduce the energy required to expand the sealing structure 112, and also allow for an increased final wall thickness as compared with related prior art applications. Moreover, as illustrated, the sealing structure 112 may have a sealing element 506 disposed about its outer radial surface. In other embodiments, however, as discussed above, the sealing element 506 may be omitted. In at least one embodiment, the sealing element 506 may be similar to the sealing element 208 of FIGS. 2A-2B, and therefore will not be described again in detail.

In the first unexpanded state 502*a*, the sealing structure 112 is in its compressed configuration and able to be run into the open hole section 102 of the wellbore 104 via the production tubing 108 (FIG. 1). The folds 504 allow the sealing structure 112 to be compacted into the contracted configuration, but also allow the sealing structure 112 to expand as the folds flatten out during expansion.

For reference, the truss structure 114 is also shown in the first unexpanded state 502*a*. As described above, the truss structure 114 may also be able to be run into the open hole section 102 through the existing production tubing 108 and therefore is shown in FIG. 5 as having essentially the same diameter as the sealing structure 112 in their respective contracted configurations.

As will be appreciated by those skilled in the art, however, in embodiments where the truss structure 114 is run into the wellbore 104 simultaneously with the sealing structure 112, the diameter of the truss structure 114 in its contracted configuration would be smaller than as illustrated in FIG. 5. Indeed, in such embodiments, the truss structure 114 would exhibit a diameter in its contracted configuration small enough to be accommodated within the interior of the sealing structure 112.

In the second expanded state 502*b*, the sealing structure 112 may be expanded to an intermediate diameter (e.g., a diameter somewhere between the contracted and fully expanded configurations). As illustrated, in the second expanded state 502*b*, various peaks and valleys may remain in the folds 504 of the sealing structure 112, but the amplitude of the folds 504 is dramatically decreased as the material is gradually flattened out in the radial direction. In one or more embodiments, the intermediate diameter may be a predetermined diameter offset from the inner radial surface of the open hole section 102 or a diameter where the sealing structure 112 engages a portion of the inner radial surface of the open hole section 102.

Where the sealing structure 112 engages the inner radial surface of the open hole section 102, the sealing element 506 may be configured to seal against said surface, thereby preventing fluid communication either uphole or downhole with respect to the sealing structure 112. In some embodiments, the sealing element 506 may be swellable or otherwise configured to expand in order to seal across a range of varying diameters in the inner radial surface of the open hole section 102. Such swelling expansion may account for abnormalities in the wellbore 104 such as, but not limited to, collapse, creep, washout, combinations thereof, and the like. As the sealing element 506 swells or otherwise expands, the valleys of the sealing structure 112 in the second expanded state 502*b* may be filled in.

In the third expanded state 502*c*, the sealing structure 112 may be expanded to its fully expanded configuration or diameter. In the fully expanded configuration the peaks and valleys of the folds 504 may be substantially reduced or otherwise eliminated altogether. Moreover, in the expanded configuration, the sealing structure 112 may be configured to engage or otherwise come in close contact with the inner radial surface of the open hole section 102. As briefly discussed above, in some embodiments, the sealing element 506 may be omitted and the sealing structure 112 itself may instead be configured to sealingly engage the inner radial surface of the open hole section 102.

Referring now to FIGS. 6A-6D, with continued reference to FIGS. 1 and 4A-4D, illustrated are progressive views of building or otherwise extending the axial length of the downhole completion system 100 within an open hole section 102 of the wellbore 104, according to one or more embodiments of the disclosure. As illustrated, an end section 106*a* may have already been successively installed within the wellbore 104 and, in at least one embodiment, its installation may be representative of the description provided above with respect to FIGS. 4A-4D. In particular, the end section 106*a* may be complete with an expanded sealing structure 112 and at least one expanded truss structure 114 arranged within the expanded sealing structure 112. Again, however, those skilled in the art will readily recognize that the end section 106*a* as shown installed in FIGS. 6A-6D may be equally replaced with an installed middle section 106*b*, without departing from the scope of the disclosure.

The downhole completion system 100 may be extended within the wellbore 104 by running one or more middle sections 106*b* into the open hole section 102 and coupling the middle section 106*b* to the distal end of an already expanded sealing structure 112 of a preceding end or middle section 106*a,b*. While a middle section 106*b* is shown in FIGS. 6A-6D as extending the axial length of the system 100 from an installed end section 106*a*, it will be appreciated that another end section 106*a* may equally be used to extend the axial length of the system 100, without departing from the scope of the disclosure.

As illustrated, the conveyance device 402 may again be used to convey or otherwise transport the sealing structure 112 of the middle section 106*b* downhole and into the open hole section 102. As with prior embodiments, in its contracted configuration the sealing structure 112 of the middle section 106*b* may exhibit a diameter small enough to traverse an existing production tubing 108 (FIG. 1) within the wellbore 104 in order to arrive at the appropriate location within open hole section 102. Moreover, the diameter of the sealing structure 112 in its contracted configuration may be small enough to pass through the expanded end section 106*a*. As depicted, the sealing structure 112 of the middle section 106*b* may be run into the wellbore 104 in conjunction with the deployment device 404 which may be configured to expand the sealing structure 112 upon actuation.

In one or more embodiments, the sealing structure 112 of the middle section 106*b* may be run into the interior of the end section 106*a* and configured to land on an upset 602 defined therein. In at least one embodiment, the upset 602 may be defined on the distal connection section 204*b* of the sealing structure 112 of the end section 106*a*, where there is a known diameter in its expanded configuration. In other embodiments, however, the upset 602 may be defined by the truss structure 114 of the end section 106*a* as arranged in the known diameter of the connection section 204*b*. In any event, the sealing structure 112 of the middle section 106*b* may be run through the end section 106*a* such that the middle section 106*b* is proximate to the end section 106*a*. In certain embodiments, the proximal connection section 204*a* of the middle section 106*b* axially overlaps the distal connection section 204*b* of the end section 106*a* by a short distance. In other embodiments, however, the adjacent sections 106*a,b* do not necessarily axially overlap at the adjacent connection sections 204*a,b* but may be arranged in an axially-abutting relationship or even offset a short distance from each other, without departing from the scope of the disclosure.

Figure 6A:
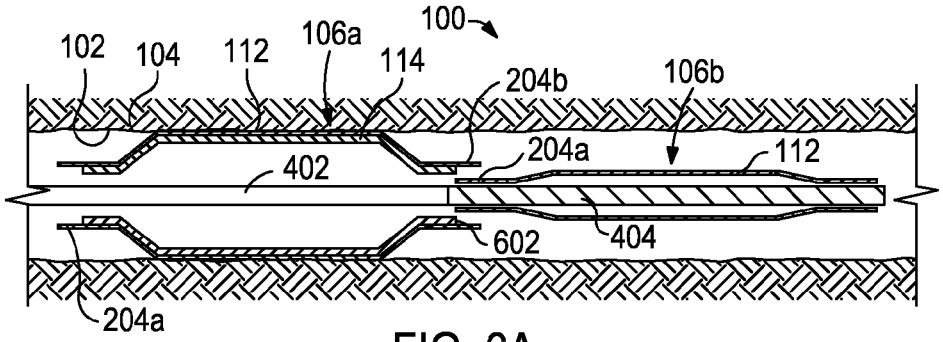
FIGS. 6A-6D illustrate progressive views of building the downhole completion system of FIG. 1 within an open hole section of a wellbore, according to one or more embodiments.
Figure 6B:
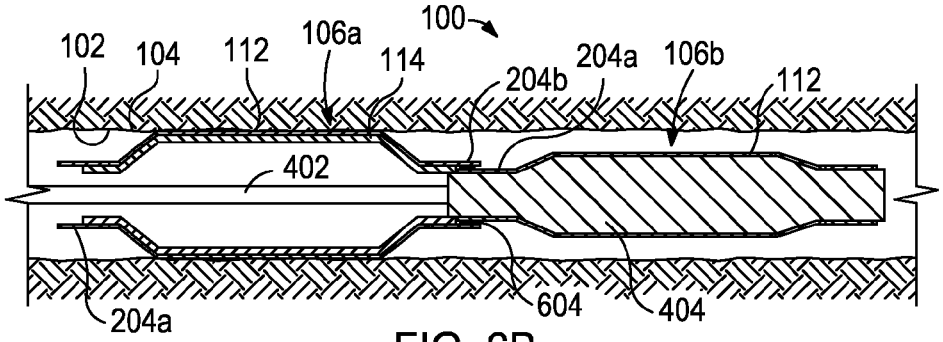

Referring to FIG. 6B, illustrated is the expansion of the sealing structure 112 of the middle section 106*b* using the deployment device 404, according to one or more embodiments. In some embodiments, the fully expanded diameter of the sealing structure 112 of the middle section 106*b* can be the same size as the fully expanded diameter of the sealing structure 112 of the end section 106*a*, such that it may also be configured to contact the inner radial surface of the open hole section 102 and potentially form a seal therebetween. In some embodiments, a sealing element (not shown), such as the sealing element 208 of FIGS. 2A and 2B, may be disposed about the outer radial surface of the sealing structure 112 of the middle section 106*b* in order to provide a seal over that particular area in the wellbore 104.

In other embodiments, the sealing structure 112 of the middle section 106*b* may be configured as a spanning element, as briefly described above, and thereby configured to expand to a smaller diameter. In yet other embodiments, the sealing structure 112 of the middle section 106*b* may be configured as a straddle element, as briefly described above, and configured to expand to a minimum borehole diameter. In such embodiments, no sealing element is disposed about the outer radial surface of the sealing structure 112, thereby allowing for a thicker wall material and also minimizing costs.

To expand the sealing structure 112 of the middle section 106*b*, as with prior embodiments, the deployment device 404 may be configured to swell and simultaneously force the sealing structure 112 to radially expand. As the sealing structure 112 of the middle section 106*b* expands, its proximal connection section 204*a* expands radially such that its outer radial surface engages the inner radial surface of the distal connection section 204*b* of the end section 106*a*, thereby forming a mechanical seal therebetween. In other embodiments, a sealing element 604 may be disposed about one or both of the outer radial surface of the proximal connection section 204*a* or the inner radial surface of the distal connection section 204*b*. The sealing element 604, which may be similar to the sealing element 208 described above (i.e., rubber, elastomer, swellable, non-swellable, etc.), may help form a fluid-tight seal between adjacent sections 106*a,b*. In some embodiments, the sealing element 604 serves as a type of glue between adjacent sections 106*a,b* configured to increase the axial strength of the system 100.

In yet other embodiments, the sealing element 604 may be replaced with a metal seal that may be deposited at the overlapping section between the proximal connection section 204*a* of the middle section 106*b* and the distal connection section 204*b* of the end section 106*a*. For example, in at least one embodiment, a galvanic reaction may be created which uses a sacrificial anode to plate the material in the cathode of the seal location. Such seal concepts are described in co-owned U.S. patent application Ser. No. 12/570,271 entitled "Forming Structures in a Well In-Situ", the contents of which are hereby incorporated by reference. Accordingly, the sealing connection between adjacent sections 106*a,b*, whether by mechanical seal or sealing element 604 or otherwise, may be configured to provide the system 100 with a sealed and robust structural connection and a conduit for the conveyance of fluid therein.

Figure 6C:
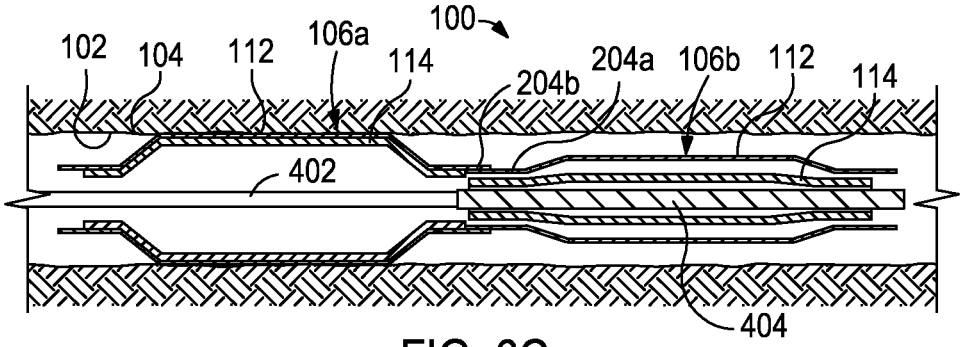

Referring to FIG. 6C, illustrated is a truss structure 114 being run into the wellbore 104 and into the expanded sealing structure 112 of the middle section 106*b*, according to one or more embodiments. Specifically, illustrated is the truss structure 114 in its contracted configuration being conveyed into the open hole section 102 using the conveyance device 402. As with prior embodiments, the truss structure 114 may exhibit a diameter in its contracted configuration that is small enough to traverse the production tubing 108 (FIG. 1), but simultaneously small enough to extend through the preceding end section 106*a* without causing obstruction. In some embodiments, the truss structure 114 may be run in contiguously or otherwise nested within the sealing structure 112 in a single run-in into the wellbore 104. In other embodiments, however, as illustrated herein, the truss structure 114 may be run into the open hole section 102 independently of the sealing structure 112, such as after the deployment of the sealing structure 112.

Figure 6D:
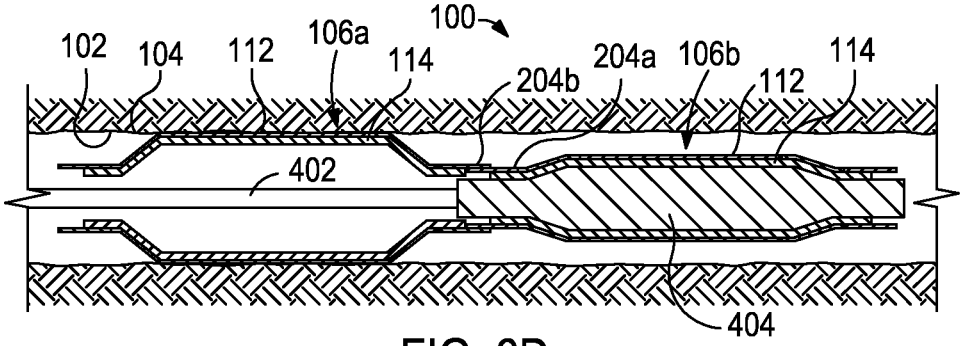

Referring to FIG. 6D, illustrated is the truss structure 114 as being expanded within the sealing structure 112 using the deployment device 404. As the deployment device 404 expands, it forces the truss structure 114 to also expand radially. After the truss structure 114 is fully expanded, the deployment device 404 may be radially contracted and removed from the deployed truss structure 114. In its expanded configuration, the truss structure 114 provides radial support to the sealing structure 112 and thereby helps prevent against wellbore 104 collapse in the open hole section 102. Moreover, expanding the truss structure 114 may help to generate a more robust seal between the proximal connection section 204*a* of the middle section 106*b* and the distal connection section 204*b* of the end section 106*a*.

It will be appreciated that each additional length of sealing structure 112 added to the downhole completion system 100 need not be structurally supported in its interior with a corresponding truss structure 114. Rather, the material thickness of the additional sealing structure 112 can be sized to provide sufficient collapse resistance without the need to be supplemented with the truss structure 114. In other embodiments, the truss structure 114 may be expanded within only a select few additional lengths of sealing structure 112, for example, in every other additional sealing structure 112, every third, every fourth, etc. or may be randomly added, depending on well characteristics. In some embodiments, the truss structures 114 may be placed in the additional sealing structures 112 only where needed, for example, only where collapse resistance is particularly required. In other locations, the truss structure 114 may be omitted, without departing from the scope of the disclosure.

In some embodiments, separate unconnected lengths of individual truss structures 114 may be inserted into the open hole section 102 of the wellbore 104 and expanded, with their corresponding ends separated or in close proximity thereto. In at least one embodiment, the individual truss structures 114 may be configured to cooperatively form a longer truss structure 114 using one or more couplings arranged between adjacent truss structures 114. This includes, but is not limited to, the use of bi-stable truss structures 114 coupled by bi-stable couplings that remain in function upon expansion. For example, in some embodiments, a continuous length of coupled bi-stable truss structures 114 may be placed into a series of several expanded sealing structures 112 and successively expanded until the truss structures 114 cooperatively support the corresponding sealing structures 112.

In some embodiments, separate unconnected lengths of individual truss structures 114 may be inserted into the open hole section 102 of the wellbore 104 and expanded, with their corresponding ends axially overlapping a short distance. For example, in at least one embodiment, a short length of a preceding truss structure 114 may be configured to extend into a subsequent truss structure 114 and is therefore expanded at least partially inside the preceding expanded truss structure 114. As will be appreciated, this may prove to be a simple way of creating at least some axial attachment by friction or shape fit, and/or otherwise ensure that there is always sufficient support for the surrounding sealing structures 112 along the entirety of its length.

Those skilled in the art will readily appreciate the several advantages the disclosed systems and methods may provide. For example, the downhole completion system 100 is able to be run through existing production tubing 108 (FIG. 1) and then assembled in an open hole section 102 of the wellbore 104. Accordingly, the production tubing 108 is not required to be pulled out of the wellbore 104 prior to installing the system 100, thereby saving a significant amount of time and expense. Another advantage is that the system 100 can be run and installed without the use of a rig at the surface. Rather, the system 100 may be extended into the open hole section 102 entirely on wireline, slickline, coiled tubing, or jointed pipe. Moreover, it will be appreciated that the downhole completion system 100 may be progressively built either toward or away from the surface within the wellbore 104, without departing from the scope of the disclosure. Even further, the final inner size of the expanded sealing structures 112 and truss structures 114 may allow for the conveyance of additional lengths of standard diameter production tubing through said structures to more distal locations in the wellbore.

Another advantage is that the downhole completion system 100 provides for the deployment and expansion of the sealing and truss structures 112, 114 in separate runs into the open hole section 102 of the wellbore 104. As a result, the undeployed system 100 is able to pass through a much smaller diameter of production tubing 108 and there would be less weight for each component that is run into the wellbore 104. Moreover, this allows for longer sections 106*a,b* to be run into longer horizontal portions of the wellbore 104. Another advantage gained is the ability to increase the material thickness of each structure 112, 114, which results in stronger components and the ability to add additional sealing material (e.g., sealing elements 208). Yet another advantage gained is that there is more space available for the deployment device 404, which allows for higher inflation pressures and increased expansion ratios. As a result, the system 100 can be optimized as desired for the high expansion conditions.

The exemplary embodiments of the downhole completion system 100 disclosed herein may be run into the open hole section 102 of the wellbore 104 using one or more downhole tractors, as known in the art. In some embodiments, the tractor and related tools can be conveyed to the open hole section 102 using wireline or slickline, as noted above. As can be appreciated, wireline can provide increased power for longer tools reaching further out into horizontal wells. As will be appreciated, the exemplary embodiments of the downhole completion system 100 disclosed herein may be configured to be run through the upper original completion string installed on an existing well. Accordingly, each component of the downhole completion system 100 may be required to traverse the restrictions of the upper completion tubing and upper completion components, as known to those skilled in the art.

In some embodiments, the exemplary embodiments of the downhole completion system 100 disclosed herein may be pushed to a location within the open hole section 102 of the wellbore 104 by pumping or bull heading into the well. In operation, one or more sealing or flow restricting units may be employed to restrict the fluid flow and pull or push the tool string into or out of the well. In at least one embodiment, this can be combined with the wireline deployment method for part or all of the operation as needed. Where the pushing operations encounter "thief zones" in the well, these areas can be isolated as the well construction continues. For example, chemical and/or mechanical isolation may be employed to facilitate the isolation. Moreover, tool retrieval can be limited by the ability of the particular well to flow.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patents or other documents that may be incorporated herein by reference, the definitions that are consistent with this specification should be adopted.

The invention claimed is:

1. A downhole completion system, comprising:

an elongate tubular sealing structure having a first open end and a second open end opposite the first open end and being movable between a contracted configuration and an expanded configuration, wherein the sealing structure is able to axially traverse production tubing extended within a wellbore in the contracted configuration, and wherein the sealing structure includes:

a first connection section defined proximate to the first open end and a second connection section defined proximate to the second open end;

a sealing section extending between the first and second connection sections; and a plurality of longitudinally-extending folds extending along the first and second connection sections and the sealing section, the longitudinally-extending folds of the sealing section exhibiting a larger frequency than the longitudinally-extending folds of at least one of the first and second connection sections;

a conveyance device configured to couple to and transport the sealing structure through the production tubing; and a deployment device configured to radially expand the sealing structure from the contracted configuration to the expanded configuration.

2. The system of claim 1, wherein, when in the expanded configuration, the sealing structure engages an inner radial surface of an open hole section of the wellbore.

3. The system of claim 1, further comprising one or more sealing elements disposed about an outer radial surface of the sealing structure, at least one of the one or more sealing elements being configured to seal against an inner radial surface of an open hole section of the wellbore when the sealing structure is in the expanded configuration.

4. The system of claim 1, wherein the deployment device comprises a hydraulic setting tool.

5. The system of claim 1, wherein the sealing section exhibits a larger expansion potential than the first and second connection sections.

6. The system of claim 1, further comprising:

a first transition section extending between the first connection section and the sealing section; and a section transition section extending between the second connection section and the sealing section, wherein the first and second transition sections exhibit a different expansion potential than the first and second connection sections and the sealing section.

7. A method of completing an open hole section of a wellbore, comprising:

conveying an elongate tubular sealing structure in a contracted configuration to the open hole section of the wellbore with a conveyance device, the sealing structure having a first open end and a second open end opposite the first open end and being movable between the contracted configuration and an expanded configuration wherein the sealing structure includes:

a first connection section defined proximate to the first open end and a second connection section defined proximate to the second open end;

a sealing section extending between the first and second connection sections; and moving the sealing structure to the expanded configuration with a deployment device when the sealing structure is arranged in the open hole section, wherein a plurality of longitudinally-extending folds extend along the first and second connection sections and the sealing section and the longitudinally-extending folds of the sealing section exhibit a larger frequency than the longitudinally-extending folds of at least one of the first and second connection sections.

8. The method of claim 7, wherein conveying the sealing structure to the open hole section comprises conveying the sealing structure through production tubing arranged within the wellbore.

9. The method of claim 8, wherein conveying the sealing structure to the open hole section is accomplished with the deployment device arranged within the sealing structure.

10. The method of claim 7, wherein moving the sealing structure to the expanded configuration comprises expanding the sealing structure such that an amplitude of the plurality of longitudinally-extending folds decreases.

11. The method of claim 7, wherein moving the sealing structure to the expanded configuration further comprises:

forcing at least a portion of the sealing structure into engagement with an inner surface of the open hole section thereby sealing at least a portion of the inner surface of the open hole section with the sealing structure.

12. The method of claim 11, wherein the portion of the sealing structure that is forced into engagement with the inner surface of the open hole section comprises one or more sealing elements disposed about an outer radial surface of the sealing structure.

13. The method of claim 7, wherein moving the sealing structure to the expanded configuration comprises:

forcing at least a portion of the sealing structure into engagement with an inner radial surface of the open hole section thereby resisting collapse of the wellbore with the sealing structure.

14. The method of claim 7, wherein the sealing structure is a first sealing structure, the method further comprising:

conveying a second sealing structure in a contracted configuration to the open hole section of the wellbore, the second sealing structure being movable between the contracted configuration and an expanded configuration;

arranging the second sealing structure proximate to the first sealing structure; and moving the second sealing structure to the expanded configuration with the deployment device.

15. The method of claim 14, wherein conveying the second sealing structure to the open hole section further comprises conveying the second sealing structure through the production tubing and distally from the first sealing structure.

16. The method of claim 14, wherein each of the first and second sealing structures have opposing first and second connection sections, and wherein moving the second sealing structure to the expanded configuration further comprises:

radially expanding the first connection section of the second sealing structure into engagement with the second connection section of the first sealing structure; and generating a mechanical seal between the first connection section of the second sealing structure and the second connection section of the first sealing structure.

17. The method of claim 16, wherein generating the mechanical seal further comprises sealing an engagement between the first connection section of the second sealing structure and the second connection section of the first sealing structure with at least one sealing element.

18. A downhole completion system, comprising:

a first sealing structure having a first open end and a second open end opposite the first open end of the first sealing structure and being movable between a contracted configuration and an expanded configuration;

a second sealing structure having a first open end and a second open end opposite the first open end of the second sealing structure and being movable between a contracted configuration and an expanded configuration, wherein the first and second sealing structures are able to axially traverse production tubing extended within a wellbore in the contracted configuration and wherein each of the first and second sealing structures includes:

a first connection section defined proximate to the first open end and a second connection section defined proximate to the second open end;

a sealing section extending between the first and second connection sections; and a plurality of longitudinally-extending folds extending along the first and second connection sections and the sealing section, the longitudinally-extending folds of the sealing section exhibiting a larger frequency than the longitudinally-extending folds of at least one of the first and second connection sections;

a conveyance device operably coupled to the first and second sealing structures and configured to transport the first and second sealing structures through the production tubing and to an open hole section of the wellbore; and a deployment device operably connected to the first and second sealing structures and configured to radially expand the first and second sealing structures from their respective contracted configurations to their respective expanded configurations when arranged in the open hole section, wherein the second sealing structure is arranged axially adjacent the first sealing structure within the open hole section.

19. The system of claim 18, wherein, when the second sealing structure is in the contracted configuration and the first sealing structure is in its expanded configuration, the second sealing structure is able to axially traverse the production tubing and the first sealing structure.

20. The system of claim 18, wherein, when the first and second sealing structures are in their respective expanded configurations, the first connection section of the second sealing structure extends into and axially overlaps the second connection section of the first sealing structure.

21. The system of claim 20, wherein radial engagement between the first connection section of the second sealing structure and the second connection section of the first sealing structure generates a mechanical seal therebetween.

22. The system of claim 20, further comprising a sealing element disposed between the first connection section of the second sealing structure and the second connection section of the first sealing structure.

23. The system of claim 18, wherein each of the first and second sealing structures further comprises:

a first transition section extending between the first connection section and the sealing section; and a section transition section extending between the second connection section and the sealing section, wherein the first and second transition sections exhibit a different expansion potential than the first and second connection sections and the sealing section.

* * * * *